US005078784A

United States Patent [19]

Craig et al.

[11] Patent Number: 5,078,784

[45] Date of Patent: Jan. 7, 1992

[54] DESULFURIZATION AGENT

[75] Inventors: Donald B. Craig, Grand Island; Thomas K. McCluhan, Tonawanda; Robert H. Kaiser, Youngstown, all of N.Y.

[73] Assignee: Elkem Metals Company, Pittsburgh, Pa.

[21] Appl. No.: 493,301

[22] Filed: Mar. 14, 1990

[51] Int. Cl.[5] ..... C21C 7/064

[52] U.S. Cl. ..... 75/309; 75/310; 75/312

[58] Field of Search ..... 75/312, 566, 309, 310, 75/565

[56] References Cited

U.S. PATENT DOCUMENTS

| | | | |
|---|---|---|---|
| 4,076,522 | 2/1978 | Yoshida . | |
| 4,260,413 | 4/1981 | Freissmuth et al. . | |
| 4,279,643 | 7/1981 | Jackman . | |
| 4,417,924 | 11/1983 | Schwer . | |
| 4,572,737 | 2/1986 | Robinson et al. . | |
| 4,753,676 | 6/1988 | Kodatsky et al. . | |
| 4,764,211 | 8/1988 | Meichsner et al. . | |
| 4,941,914 | 7/1990 | Craig et al. | 75/312 |
| 4,988,387 | 1/1991 | Schrodter et al. | 75/312 |

FOREIGN PATENT DOCUMENTS

| | | | |
|---|---|---|---|
| 167711 | 10/1983 | Japan | 75/312 |
| 848567 | 9/1960 | United Kingdom | 75/566 |

OTHER PUBLICATIONS

"Slags and Fluxes for Ferrous Ladle Metallurgy", E. T. Turkdogan, Iron and Steelmaking, 1985, vol. 12, No. 2, pp. 64–78.

"Desulfurization of Hot Metal with Burnt Lime", Tatsuo Ohya, et al., Steelmaking Proceedings, 1977, pp. 90–97.

"Hot Metal Desulfurization–N. American Experience with CaD", H. A. Corver et al., Iron and Steel Engineer, May 1980, pp. 53–55.

"The Activity of Iron Oxide in ($CaO+CaF_2+SiO_2+Fe_xO$) Slags", M. J. U. T. van Wijngaarden et al., Transactions of the ISS, Feb. 1988, I&SM–49–56.

*Primary Examiner*—Melvyn J. Andrews

*Attorney, Agent, or Firm*—Lucas & Just

[57] ABSTRACT

The desulfurization agent for molten iron is made up of 70 to 95% commercial calcium carbide, 5 to 25% silicon dioxide, 0 to 10% of a metal oxide; and 0 to 5% calcium fluoride. The metal oxides are iron oxides and manganese oxides. The desulfurizing agent has been found to reduce the amount of calcium carbide in the resulting slag.

17 Claims, No Drawings

DESULFURIZATION AGENT

This invention relates to a desulfurization agent for molten iron and a method for reducing the residual calcium carbide in slag, produced during desulfurization of molten iron.

Conventionally, desulfurization of iron, in many respects, is significantly different from desulfurization of steel. For instance, the slag phase in a steel desulfurization process is typically a liquid while the slag from an iron desulfurization process is typically a solid.

Conventionally, desulfurization of iron is conducted subsequent to a cupola or some other melting unit by the addition of a desulfurization agent to a melt of molten iron in a ladle. In the case of ductile iron, granulated commercial calcium carbide is the standard desulfurization agent. Generally, commercial calcium carbide is added to a stream of molten iron as it enters a ladle equipped with a porous plug. The porous plug is used to produce a stream of bubbles of an inert gas such as argon or nitrogen through the molten iron in order to obtain good mixing between the calcium carbide and liquid iron. Other mechanical and pneumatic mixing devices are also employed on occasion.

Commercial calcium carbide, also referred to as technical, industrial or foundry grade, comprises about 70 to about 85% by weight calcium carbide, $CaC_2$, and about 15 to about 25% by weight of a mixture of calcium oxide, CaO, and calcium hydroxide, $Ca(OH)_2$; the remaining about 5% are miscellaneous ingredients.

For desulfurizing iron, calcium carbide in combination with other compounds has been suggested in the art. Specifically, U.S. Pat. No. 4,260,413 issued Apr. 7, 1981 teaches coating calcium carbide with carbon as a lubricant to increase storage life and improve the flowability of calcium carbide.

U.S. Pat. No. 4,572,737 issued Feb. 25, 1986 teaches coating calcium carbide with a compound having a contact angle with the molten iron that is less than the contact angle of calcium carbide with the molten iron. The suggested compounds used to coat the calcium carbide are titanium oxide, ferric oxide ($Fe_2O_3$), calcium aluminate ($3CaO.Al_2O_3$), calcium hydroxide ($Ca(OH)_2$), fluorspar ($CaF_2$), iron powder, fumed titania, and fumed silica. A binding agent can be used to adhere the coating compound to the calcium carbide.

U.S. Pat. No. 4,753,676 issued June 28, 1988 teaches a process for desulfurizing iron melts using a mixture of commercial calcium carbide and diamide lime. The '676 patent also alleges that commercial calcium carbide used in combination with diamide lime reduces the amount of residual calcium carbide in slag.

U.S. Pat. No. 4,764,211 issued Oct. 16, 1988 teaches using a mixture of industrial calcium carbide and dried coal which contains at least 15% by weight of volatile constituents. Magnesium, aluminum oxide, aluminum, and fluorspar may also be included in the desulfurization agent of the '211 patent.

The exact chemical interaction between calcium carbide and sulfur to effect desulfurization of the iron melt is not exactly known. It is thought that the calcium carbide dissociates into calcium, which reacts with the sulfur dissolved in the iron to form calcium sulfide (CaS), and carbon, which is a by-product of this reaction. It is also thought that the calcium sulfide forms a layer on the surface of the calcium carbide particle which tends to hinder further reaction between the calcium carbide and sulfur. Calcium carbide/calcium sulfide, calcium carbide and calcium sulfide are thought to be solids in the iron melt, and, due to their low relative density, they tend to rise to the top of the melt. At the top of the melt these solid materials form a portion of a slag phase that is subsequently removed from the top of the melt. Typically, in the desulfurization process of iron with commercial calcium carbide, the calcium carbide is not entirely consumed and the slag removed from the melt contains residual calcium carbide. Disposal of this slag can create a potential problem because the residual calcium carbide in the slag can be converted to acetylene when it comes into contact with water, e.g., humidity, rain, melting snow.

Acetylene generated from commercial calcium carbide is a gas at normal temperature and pressure and can be toxic when inhaled. At normal pressure and temperature it is flammable and burns a sooty flame. At 2 atmospheres or more, it can become explosive by decomposition or ignition by a spark. Because of acetylene's explosive capability, it is generally handled cautiously.

Slag from the desulfurization process of molten iron has come under scrutiny from the United States Environmental Protection Agency (EPA) because of the residual calcium carbide contained therein. The EPA has decided that if the amount of residual calcium carbide in the slag is too high, the slag may be classified as a hazardous waste. Foundries, in general, have realized the need to reduce the amount of residual calcium carbide in slag.

A method for reducing the amount of residual calcium carbide in slag has now been discovered. The present invention is an improved process for desulfurizing an iron melt wherein the iron melt is treated with a desulfurization agent and the resulting slag is removed from the surface of the melt, the improvement comprising treating the iron melt with a desulfurizing agent comprising a uniform mixture of commercial calcium carbide and silicon dioxide. The desulfurization agent of the present invention minimizes the amount of residual calcium carbide in the slag.

The desulfurization agent employed in the present invention comprises a uniform mix of commercial calcium carbide and silicon dioxide. Preferably, a metal oxide selected from the group consisting of an iron oxide and a manganese oxide is included in the formulation of the desulfurizing agent of the present invention. In another preferred embodiment of the present invention, calcium fluoride ($CaF_2$) is added to the uniform mix of calcium carbide and silicon dioxide alone or in combination with the metal oxide. The preferred metal oxides are ferric oxide ($Fe_2O_3$), ferrosoferric oxide ($Fe_3O_4$), manganic oxide ($Mn_2O_3$) and manganomanganic oxide ($Mn_3O_4$).

It has been found that by employing the desulfurizing agent of the present invention, a slag low in residual calcium carbide is produced.

It was both surprising and unexpected that the combination of calcium carbide and silicon dioxide lowered the amount of residual calcium carbide in the slag. It was also surprising that this combination worked as a desulfurization agent because silicon dioxide is known to have a deleterious effect on desulfurization of steel. It has also been found that by employing the desulfurization agent of the present invention, the amount of commercial calcium carbide needed to reduce the sulfur content of the iron to a desired level is less than the amount needed using commercial calcium carbide alone.

More specifically, a method has been discovered for reducing residual calcium carbide in slag obtained from a conventional process of desulfurizing an iron melt with commercial calcium carbide. The method comprises forming a uniform mixture of commercial calcium carbide and silicon dioxide; desulfurizing said iron melt with said mixture; and recovering a slag low in calcium carbide.

Preferably, the step of forming the uniform mixture of commercial calcium carbide and silicon dioxide includes the step of adding a metal oxide selected from the group consisting of an iron oxide and a manganese oxide to said mixture. Additionally, it is preferred that in forming the uniform mix of calcium carbide and silicon dioxide that calcium fluoride be added alone or in combination with the metal oxide to the mix.

The amount of silicon dioxide employed in the desulfurization agent of the present invention is about 5 to about 25% by weight; and more preferably about 10 to about 20% by weight. Even more preferred is to use about 12 to about 18% by weight silicon dioxide in the uniform mix.

The amount of metal oxide present in the desulfurization agent of the present invention is preferably about 0.5 to about 10% by weight and more preferred is about 2 to 8% by weight. Better results are obtained using about 3 to about 6% by weight metal oxide in the mix.

The amount of calcium fluoride in the mix of the present invention is about 0.1 to about 5% by weight, and more preferably about 0.5 to about 3% by weight. Better results are obtained using about 1 to about 2% by weight calcium fluoride in the mix of the present invention.

The amount of commercial calcium carbide in the desulfurization agent of the present invention is the remainder of the desulfurization agent after the addition of the other components. Preferably the desulfurization agent contains about 60 to about 95% by weight, more preferably about 70 to about 90%. Even more preferred is about 75 to about 85% by weight commercial calcium carbide in the mix.

Preferably, the desulfurizing agent of the present invention comprises about 60 to about 95% by weight of commercial calcium carbide; about 5 to about 25% by weight of silicon dioxide; about 0 to about 10% by weight of a metal oxide selected from the group consisting of an iron oxide and a manganese oxide; and about 0 to about 5% by weight calcium fluoride.

More preferably the desulfurization agent of the present invention comprises about 70 to about 90% by weight commercial calcium carbide, about 10 to about 20% by weight silicon dioxide; about 2 to about 8% by weight metal oxide; and about 0.5 to about 3% by weight calcium fluoride.

Even more preferred is a desulfurization agent comprising about 75 to about 85% by weight commercial calcium carbide, about 12 to about 18% by weight silicon dioxide; about 3 to about 6% by weight metal oxide; and about 1 to 2% by weight calcium fluoride.

Good reduction in residual calcium carbide in the slag phase of the iron melt is obtained by employing the desulfurization agent of the present invention comprising about 5 to about 25% by weight silicon dioxide and more preferably about 10 to about 20% by weight silicon dioxide. The remainder of the desulfurization agent is commercial calcium carbide.

In another embodiment of the desulfurization agent of the present invention, the desulfurization agent comprises about 5 to about 25% by weight silicon dioxide and about 0.5 to about 10% by weight metal oxide and, more preferably, about 2 to about 8% by weight metal oxide with about 10 to about 20% by weight silicon dioxide, the remainder being commercial calcium carbide.

In yet another embodiment of the desulfurization agent of the present invention, the desulfurization agent comprises about 5 to about 25% by weight silicon dioxide and about 0.1 to about 5% by weight calcium fluoride, more preferably, about 10 to about 20% by weight silicon dioxide and about 0.5 to about 3% by weight calcium fluoride, the remainder being commercial calcium carbide.

Good results have been obtained with the desulfurization agent of the present invention consisting essentially of the components listed above in their stated proportions.

The desulfurization agent of the present invention is used in a particulate form, preferably 12 mesh×30 mesh. The particulate form can be made from a loose uniform mixture of ingredients or, more preferably, by compacting a uniform loose mixture of ingredients and sizing the compacted product to the preferred size to form a uniform, compacted mixture of the desulfurizing agent of the present invention. Compacting is done in a conventional and convenient manner.

A suitable method for making the uniform compacted desulfurization agent of the present invention is one in which weighted portions of the components on a continuous belt are subjected to a conventional roll compactor which forms a sheet of material. Next, the sheet is passed through a granulator. The granulated sheet is then sized with conventional screens. The oversize goes to a hammer mill, for example, while the undersize goes back to the belt. It is important that the components of the desulfurization agent of the present invention are uniformly mixed together and held in close association with each other. The commercial calcium carbide helps to bind and hold all the components in close association with each other. A binder such as asphalt could also be used; however, such a binder is not preferred because of the smoke and soot which evolve when the desulfurization agent of the present invention is added to the melt. Preferably, the calcium carbide binds the components together and holds them in close proximity to each other. During compaction, it has been found that the calcium carbide is forced to flow and will at least partially encompass the other components of the desulfurization agent of the present invention. It is noted that silicon dioxide; the metal oxide and the calcium fluoride do not in any way coat the calcium carbide.

The phrase "commercial calcium carbide" as used in the specification and claims means commercial or industrial grade calcium carbide. Commercial calcium carbide comprises about 70 to about 85% by weight pure calcium carbide, $CaC_2$, about 15 to about 25% by weight of a mixture of calcium oxide, CaO, and calcium hydroxide, $Ca(OH)_2$, and less than about 5% miscellaneous ingredients. Suitable commercial calcium carbide has a size of about 30 mesh×D and more preferably 30 mesh by 150 mesh.

When the desulfurization agent of the present invention is made with commercial calcium carbide, the desulfurization agent comprises about 50 to about 78% by weight of pure calcium carbide; and about 12 to about 20% by weight of a mixture of calcium oxide and calcium hydroxide. More preferably, the desulfurization agent of the present invention when made with commercial calcium carbide comprises about 56 to about 70% by weight pure calcium carbide; and about 14 to about 18% by weight of a mixture of calcium oxide and calcium hydroxide. Even more preferably the desulfurization agent of the present invention made with commercial calcium carbide comprises about 60 to about 68% by weight pure calcium carbide; and about 15 to about 17% by weight of a mixture of calcium oxide and calcium hydroxide.

Suitable manganese oxides include manganous oxide (MnO), manganic oxide ($Mn_2O_3$), manganese dioxide ($MnO_2$) and manganomanganic oxide ($Mn_3O_4$). Preferably, manganic oxide or manganomanganic oxide is used. The manganese oxide is in particulate form and, preferably, measures about 40 mesh×D. Conventional sources of particulate manganomanganic oxide, $Mn_3O_4$, are used in the present invention. Suitable sources of manganomanganic oxide include reagent grade and pigment grade. Another possible source of manganomanganic oxide is the fume from a ferromanganese refining vessel. Typically, the chemical analysis of a suitable pigment grade manganomanganic oxide is about 60 to about 70% manganese, about 1 to about 2% iron, about 1 to about 5% calcium oxide, and about 1 to about 5% magnesium oxide. Any suitable conventional source of particulate manganic oxide is used in the present invention.

Suitable iron oxides include ferric oxide ($Fe_2O_3$), ferrosoferric oxide ($Fe_3O_4$) and ferrous oxide (FeO). Preferably, ferric oxide or ferrosoferric oxide is used. Any conventional source of particulate ferric oxide, $Fe_2O_3$, is used in the present invention. Ferric oxide, also known as red iron oxide, non-magnetic iron oxide, and red rouge, is typically about 100% $Fe_2O_3$. Suitable sources of ferric oxide include not only reagent grade and pigment grade, but also certain iron ores high in ferric oxide. Any conventional source of ferrosoferric oxide, $Fe_3O_4$, is used. Ferrosoferric oxide, also known as black iron oxide, magnetic iron oxide, and black rouge, has a typical composition of about 50% by weight ferrous oxide, FeO, and about 50% by weight ferric oxide, $Fe_2O_3$. Suitable sources of ferrosoferric oxide are pigment grade, iron ores high in ferrosoferric oxide and mill scale. The iron oxide is in particulate form and, preferably, measures about 40 mesh×D.

Any conventional source of calcium fluoride can be used in the desulfurizing agent of the present invention. Preferably, fluorspar ($CaF_2$) is used having a particle size of about 40 mesh×D.

Any conventional source of silicon dioxide ($SiO_2$) can be used in the present invention. Suitable source include silica sand and silica fume. It is preferred that the silicon dioxide used in the present invention have a particle size of about 40 mesh×D.

A good source of silicon dioxide is silica fume which is a co-product from the manufacture of silicon metal and ferrosilicon. Silica fume is captured as a finely divided particle from the stack gas from the furnace and usually contains at least about 60% silicon dioxide. Typically, silica fume collected from a bag filter of a silicon metal furnace contains about 90 to 98% silicon dioxide, while silica fume from a 75% ferrosilicon furnace contains about 85 to 90% silicon dioxide.

It will be understood that the calcium oxide present in the desulfurization agent of the present invention comes from the commercial calcium carbide. This calcium oxide is present in the desulfurization agent of the present invention as being calcium oxide and calcium hydroxide and typically is present in an amount between about 10 to 25% by weight based on the weight of the desulfurization agent.

The melt of iron is desulfurized in a conventional manner using the desulfurization agent of the present invention. Good results have been obtained in both continuous and batch operations by addition of the desulfurization agent to a stream of molten iron as it is poured into the mixing ladle.

The desulfurization agent of the present invention is added to the molten iron in an amount of about 0.2% to about 2.0% by weight molten iron. In fact, it has been found that the desulfurization agent of the present invention can be substituted on a 1:1 weight basis in commercial operations for conventional commercial calcium carbide. This provides a reduction in the amount of commercial calcium carbide used to desulfurize the iron melt.

These and other aspects of the present invention may be more fully understood by reference to the following examples.

EXAMPLE 1

This example compares commercial calcium carbide to the present invention.

Table 1 below lists the results. It can be seen, when compared to commercial calcium carbide alone, that the desulfurization agent of the present invention produced a slag lower in residual calcium carbide.

TABLE 1

| | Desulfurization Agent** | | | | |
|---|---|---|---|---|---|
| | A | B* | C* | D* | E* |
| Initial Sulfur, % | 0.13 | 0.115 | 0.115 | 0.087 | 0.12 |
| Final Sulfur, % | 0.006 | 0.003 | 0.002 | 0.014 | 0.002 |
| Residual $CaC_2$, % | 5.47 | 0.141 | 0.08 | 0.126 | 0.042 |
| $CaC_2$, % | 100 | 82 | 82 | 79 | 78 |
| $SiO_2$, % | 0 | 18 | 17 | 18 | 16 |
| $CaF_2$, % | 0 | 0 | 1 | 0 | 1 |
| $Mn_3O_4$, % | 0 | 0 | 0 | 3 | 5 |

*Agent in a compacted form, 12 mesh × 30 mesh
**All test results were the average of two experiments The desulfurization agents of the present invention, B–E, used in this example were made by mixing and compacting the particulate components. The compacted components were crushed and sized to a compacted particulate form, 12 mesh×30 mesh. Desulfurization agents E and D were made with pigment grade manganomanganic oxide obtained from Elkem Metals Company under the name M34. The silicon dioxide employed in desulfurization agents B–E was conventional silica sand. The calcium fluoride employed in desulfurization agents C and E was ceramic grade fluorspar. The calcium carbide was a commercial grade of calcium carbide.

The following procedures were used to conduct the above-identified tests. Using an induction furnace, a total of ten melts of molten iron were prepared, two for testing with calcium carbide and two with each of the desulfurization agents of the present invention. Each melt weighed 75 pounds (34 Kg) and had a typical chemical analysis of:

| Typical Melt Chemical Analysis % by Weight | |
|---|---|
| Iron | Balance |
| Carbon | 3.6 |
| Sulfur | 0.1 |
| Manganese | 0.6 |
| Silicon | 2.0 |

To each melt, 0.75 pounds (340 grams) of desulfurization agent was added (1% addition). The agent was added as a particulate and nitrogen was bubbled in through a graphite tube positioned in the middle of the melt. The purpose of the gas was to provide mixing within the furnace crucible. The temperature of the molten iron was 1475° C. The melt was treated for about 8 minutes and then the slag was skimmed off the top of the melt. Samples of the molten iron were taken for sulfur analysis before treatment with the desulfurization agent, and after treatment with the desulfurization agent at 2 minute intervals, measured from the point of addition of the desulfurization agent. A conventional combustion technique was used to determine the sulfur content of the molten iron.

The amount of residual calcium carbide in the slag was determined in this example by weighing out a 15 g sample of the slag, crushing the sample to pass through a 10 mesh screen and placing that sample in a closed 8 cu. ft. vessel along with a jar containing 200 ml of 10% hydrochloric acid solution. The vessel was sealed and slag was immersed in acidic solution. Any acetylene generated by the reaction of water and calcium carbide is contained within the vessel. A sample of the acetylene/air mixture was drawn from the vessel at 5 minute intervals for a period of one hour. The percentage acetylene in the air was then measured using conventional gas chromatographic techniques with a Foxboro gas chromatograph. The percent calcium carbide was calculated from the percent of acetylene in the air.

It has been found that this test provides a very accurate method for determining the actual amount of residual calcium carbide in the slag.

EXAMPLE 2

This example illustrates use of the desulfurization agent of the present invention in a commercial operation.

TABLE II

| | Desulfurization Agent | |
|---|---|---|
| | A | E* |
| Initial Sulfur, % | 0.085 | 0.085 |
| Final Sulfur, % | 0.008 | 0.008 |
| Residual $CaC_2$, % | 12 | 0.5 |
| Addition, % | 0.75 | 0.6 |

*Agent in compacted form, 12 mesh × 30 mesh

In this particular commercial foundry, loose particulate commercial calcium carbide having a size of about 10 mesh×60 mesh was used at an addition rate of about 0.75% by weight based on the weight of the iron melt. This process used a continuous desulfurization ladle with one porous plug in the bottom thereof. The amount of residual calcium carbide in the slag using the commercial calcium carbide was about 12% by weight of slag.

The desulfurization agent E of Example 1 above, compacted and subsequently crushed to a particulate size of about 12 mesh×30 mesh, was used to replace the commercial calcium carbide. Desulfurization agent E was added to the melt at a rate of 0.6% by weight.

The iron melt during desulfurization by both commercial calcium carbide and the desulfurization agent of the present invention had a typical analysis before desulfurization of:

| | % by Weight |
|---|---|
| Iron | Balance |
| Carbon | 3.85 |
| Silicon | 1.95 |
| Manganese | 0.30 |
| Sulfur | 0.065 |

Typically, the iron after desulfurization with both commercial calcium carbide and the desulfurization agent of the present invention had a sulfur content of about 0.008 percent by weight.

In both cases, desulfurization with commercial calcium carbide and with the desulfurization agent of the present invention, the residence time of the iron in the desulfurization ladle was about six minutes.

The residual calcium carbide in the slag recovered from the melt after desulfurization with the desulfurization agent of the present invention was about 0.5% by weight based on slag. The percent calcium carbide in the slag for both the commercial calcium carbide and the desulfurization agent of the present invention was determined in accordance with the method disclosed in Example 1 above.

This example illustrates not only a reduction in the amount of commercial calcium carbide used to desulfurize the melt but also a reduction in the amount of residual calcium carbide in the slag.

EXAMPLE 3

This example illustrates use of the desulfurization agent of the present invention in another commercial foundry.

TABLE III

| | Desulfurization Agent | |
|---|---|---|
| | A | E* |
| Initial Sulfur, % | 0.09 | 0.12 |
| Final Sulfur, % | 0.008 | 0.012 |
| Residual $CaC_2$, % | 4.2 | 0.29 |
| Addition, % | 0.4 | 0.45 |

*Agent in compacted form, 12 mesh × 30 mesh

In this test, loose particulate commercial calcium carbide having a size of 10 mesh×60 mesh was used at an addition rate of about 0.4% by weight based on the weight of the iron melt. This process used a continuous desulfurization ladle with three porous plugs in the bottom thereof. The amount of residual calcium carbide in the slag using the commercial calcium carbide was about 4.2% by weight of slag.

The desulfurization agent E of Example 1 above, compacted and subsequently crushed to a particulate size of about 12 mesh×30 mesh, was used to replace the commercial calcium carbide. Desulfurization agent E was added to the melt at a rate of 0.45% by weight.

The iron melt during desulfurization by both commercial calcium carbide and the desulfurization agent of the present invention had a typical analysis before desulfurization of about:

| | % by Weight |
|---|---|
| Iron | Balance |
| Carbon | 3.8 |
| Silicon | 1.4 |
| Manganese | 0.30 |
| Sulfur | 0.1 |

Typically, the sulfur level in the iron after desulfurization with commercial calcium carbide was about 0.008% by weight; the sulfur level in the iron after desulfurization with the desulfurization of the present invention was about 0.012% by weight.

In both cases, desulfurization with commercial calcium carbide and with the desulfurization agent of the present invention, the residence time of the iron in the desulfurization ladle was about six minutes.

The residual calcium carbide in the slag recovered from the melt after desulfurization with the desulfurization agent of the present invention was about 0.29% by weight based on slag. The percent calcium carbide in the slag for both the commercial calcium carbide and the desulfurization agent of the present invention was determined in accordance with the method disclosed in Example 1 above.

It will be understood that it is intended to cover all changes and modifications of the preferred embodiments herein chosen for the purpose of illustration which do not constitute a departure from the spirit and scope of the invention.

What is claimed is:

1. A desulfurization agent for an iron melt which minimizes the amount of residual calcium carbide in the slag, said desulfurization agent comprising a uniform mixture of about 60% to about 95% by weight commercial calcium carbide and about 5 to about 25% by weight silicon dioxide.

2. The desulfurization agent of claim 1 wherein the uniform mixture further comprises about 0.5 to about 10% by weight of a metal oxide selected from the group consisting of an iron oxide and a manganese oxide.

3. The desulfurization agent of claim 1 wherein the uniform mixture further comprises about 0.1 to about 5% by weight calcium fluoride.

4. The desulfurization agent of claim 2 wherein the uniform mixture further comprises about 0.1 to about 5% by weight calcium fluoride.

5. The desulfurization agent of claim 2 wherein the iron oxide and manganese oxide are selected from the group consisting of ferric oxide, manganomanganic oxide, manganic oxide and ferrosoferric oxide.

6. A desulfurization agent for an iron melt which minimizes the amount of residual calcium carbide in the slag, said desulfurization agent comprising a uniform mixture of:

about 60 to about 95% by weight commercial calcium carbide;

about 5 to about 25% by weight silicon dioxide; and about 0.1 to about 5% by weight calcium fluoride.

7. The desulfurization agent of claim 6 wherein the uniform mixture further comprises about 0.5 to about 10% by weight of a metal oxide selected from the group consisting of an iron oxide and a manganese oxide.

8. The desulfurization agent of claim 7 wherein said uniform mixture is a compacted mixture in a particulate form.

9. The desulfurization agent of claim 7 wherein the uniform mixture comprises:

about 75 to about 85% by weight commercial calcium carbide;

about 12 to about 18% by weight silicon dioxide;

about 3 to about 6% by weight metal oxide; and about 1 to about 2% by weight calcium fluoride.

10. The desulfurization agent of claim 7 wherein the iron oxide and manganese oxide are selected from the group consisting of ferric oxide, manganomanganic oxide, manganic oxide and ferrosoferric oxide.

11. A desulfurization agent for an iron melt which minimizes the amount of residual calcium carbide in the slag, wherein said desulfurization agent is a uniform mix consisting essentially of:

about 60% to about 95% by weight commercial calcium carbide;

about 5% to about 25% by weight silicon dioxide;

about 0% to about 10% by weight of a metal oxide selected from the group consisting of iron oxide and manganese oxide; and about 0% to about 5% calcium fluoride.

12. The desulfurization agent of claim 11 wherein the amount of metal oxide is about 0.5% to about 10% by weight.

13. The desulfurization agent of claim 11 wherein the amount of calcium fluoride is about 0.1% to about 5% by weight.

14. The desulfurization agent of claim 11 wherein said iron oxide and managanese oxide are selected from the group consisting of ferric oxide, manganomanganic oxide, manganic oxide and ferrosoferric oxide.

15. The desulfurization agent of claim 11 wherein the said uniform mixture is a compact mixture in a particulate form.

16. The desulfurization agent of claim 12 wherein the amount of calcium fluoride is about 0.1% to about 5% by weight.

17. The deusulfurization agent of claim 15 wherein said uniform mixture is a compact mixture in a particulate form and said iron oxide and manganese oxide is selected from the group consisting of ferric oxide, ferrosoferric oxide, manganic oxide and manganomanganic oxide.

* * * * *

UNITED STATES PATENT AND TRADEMARK OFFICE

CERTIFICATE OF CORRECTION

PATENT NO. : 5,078,784

DATED : January 7, 1992

INVENTOR(S) : Donald B. Craig et al.

It is certified that error appears in the above-identified patent and that said Letters Patent is hereby corrected as shown below:

Column 5, line 52, change "$Si_{02}$" to --$SiO_2$--.

Claim 14, line 2, change "managanese" to --manganese--.

Claim 17, line 3, change "is" to --are--.

Signed and Sealed this

Eighth Day of June, 1993

*Attest:*

Michael K. Kirk

MICHAEL K. KIRK

*Attesting Officer*

*Acting Commissioner of Patents and Trademarks*